United States Patent [19]

Sweeney et al.

[11] Patent Number: 4,516,743

[45] Date of Patent: May 14, 1985

[54] SCANNING BEAM BEAMRIDER MISSILE GUIDANCE SYSTEM

[75] Inventors: Donald W. Sweeney, Livermore, Calif.; Neal C. Gallagher, West Lafayette, Ind.; Charles R. Christensen, Athens, Ala.

[73] Assignee: The United States of America as represented by the Secretary of the Army, Washington, D.C.

[21] Appl. No.: 486,127

[22] Filed: Apr. 18, 1983

[51] Int. Cl.[3] ..... F41G 7/26

[52] U.S. Cl. ..... 244/3.13

[58] Field of Search ..... 244/3.13

[56] References Cited

U.S. PATENT DOCUMENTS

| | | | |
|---|---|---|---|
| 3,255,984 | 6/1966 | Hawes | 244/3.13 |
| 3,416,751 | 12/1968 | Larson | 244/3.13 |
| 3,513,315 | 5/1970 | Sundstrom et al. | 244/3.13 |
| 3,782,667 | 1/1974 | Miller et al. | 244/3.13 |
| 3,807,658 | 4/1974 | Miller, Jr. et al. | 244/3.13 |
| 4,179,085 | 12/1979 | Miller | 244/3.11 |
| 4,243,187 | 1/1981 | Esker | 244/3.13 |

FOREIGN PATENT DOCUMENTS

| | | | |
|---|---|---|---|
| 2033186 | 5/1980 | United Kingdom | 244/3.13 |

OTHER PUBLICATIONS

O. Bryngdahl and W. Lee, Laser Beam Scanning Using Computer-Generated Holograms, Applied Optics, vol. 15, No. 1, Jan. 1976, pp. 183–194.

*Primary Examiner*—Charles T. Jordan

*Attorney, Agent, or Firm*—Anthony T. Lane; Robert P. Gibson; Freddie M. Bush

[57] ABSTRACT

A beamrider guidance system for missiles wherein a laser beam is given two circular motions around the boresight axis to produce amplitude and phase modulation on the signal received at the missile. The information on distance from boresight is contained in the amplitude modulation and the angular information is contained as phase modulation. A laser optical system with a spinning holographic element provides one of the circular motions for the beam. The other circular motion is provided by a low frequency, circular scanning mirror.

8 Claims, 5 Drawing Figures

SCANNING BEAM BEAMRIDER MISSILE GUIDANCE SYSTEM

DEDICATORY CLAUSE

The invention described herein may be manufactured, used, and licensed by or for the Government for governmental purposes without the payment to us of any royalties thereon.

BACKGROUND OF THE INVENTION

Beamrider guidance is a form of Command Line Of Sight (CLOS) guidance system. In this system a beam is projected from a launch position toward a target. The beam is spatially coded so that as the missile looks backward toward the projected beam it can determine its position with respect to the center of the beam or boresight. Therefore, the missile can track the beam to the target.

An advantage of beamrider guidance is the versatility available in beam encoding techniques. For example, three different encoding methods are four quadrant, bar scan, and FM reticle. The four quadrant technique employs four lasers that each provide one quadrant of the total beam. Each laser is pulse position modulated with a code unique to its quadrant. The beam is nutated about the line of sight. A missile on the boresight axis spends an equal amount of time in each quadrant during a nutation cycle, while an off-axis missile receives unequal durations of the quadrant codes corresponding to its position relative to the line of sight. This allows the missile to generate its correctional commands internally.

The bar scan or L beam method of spatial encoding provides more efficient use of laser power because only a vertical bar and a horizontal bar are transmitted. The vertical and horizontal bars are nutated and modulated with an azimuth and elevation code, respectively. When one of the beams crosses the missile receiver, the resulting pulse burst is identified as azimuth or elevation. In this manner the position of the missile relative to boresight can be determined.

The FM reticle method is an encoding technique that requires only one laser. This method employs a reticle composed of alternate transparent and opaque segments. The reticle rotates through the laser beam, projecting the image of the spinning reticle to a missile, resulting in a condition that will generate a fixed modulation frequency at the receiver of a missile located anywhere in the field of view. The reticle also revolves about the guidance field producing an FM signal at the receiver that, when synchronously detected with respect to the revolution angle, provides position information relative to the line of sight.

SUMMARY OF THE INVENTION

A beamrider guidance system for a missile wherein a single laser beam is used. The laser beam has two separate circular motions which occur simultaneously and are referenced to the target tracker boresight axis to produce amplitude and phase modulation on the signal received at a missile launched into the beam, toward a target. Information of the distance from the boresight axis to the missile is contained in the amplitude modulation. Angular information is contained in the phase modulation. A 10.6 micron wavelength laser with a holographic scanning element and a mirror adapted for causing low frequency circular scan provides the primary optical system functions.

DESCRIPTION OF THE PREFERRED EMBODIMENT

Figure 1:
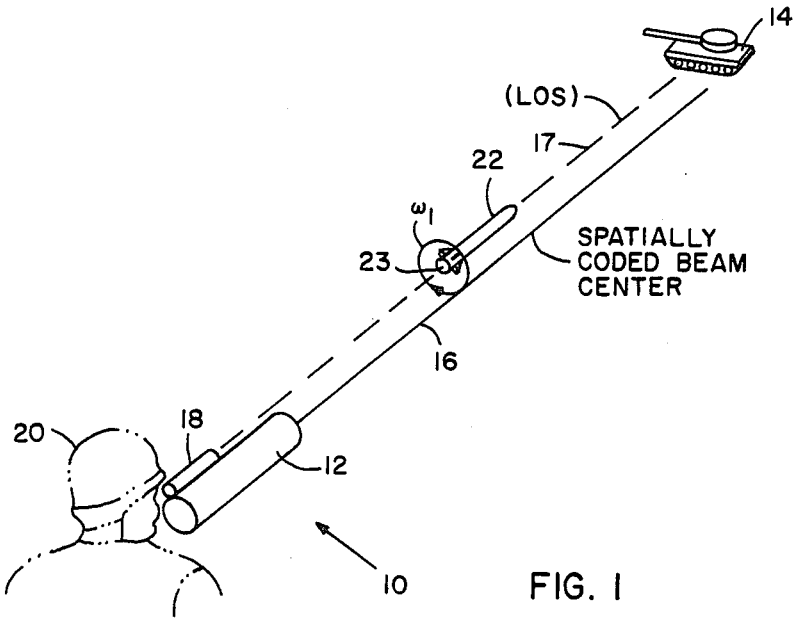
FIG. 1 is a diagram of a beamrider guidance system embodiment.

Referring now to the drawings wherein like numbers refer to like parts, FIG. 1 discloses an optical beamrider system embodying the guidance method. A target tracking station 10 directs an optical beam from a transmitter 12 toward a target 14. The optical beam is directed substantially along a path 16 which is rotated $\omega_1$ around a tracker boresight axis 17. Transmitter 12 is boresighted to follow telescope 18 or other means for tracking a target by an observer 20 at the tracking station. A missile 22 is launched (not shown) into the path of the beam toward the target. An optical receiver 23 on the missile aft end responds to the spatially coded laser beam for directing the missile toward the boresight axis or line-of-sight to the target. The laser beam center is rotated in a circular pattern around the line-of-sight axis (LOS) between the target tracking station 10 and the target 14.

Figure 2:
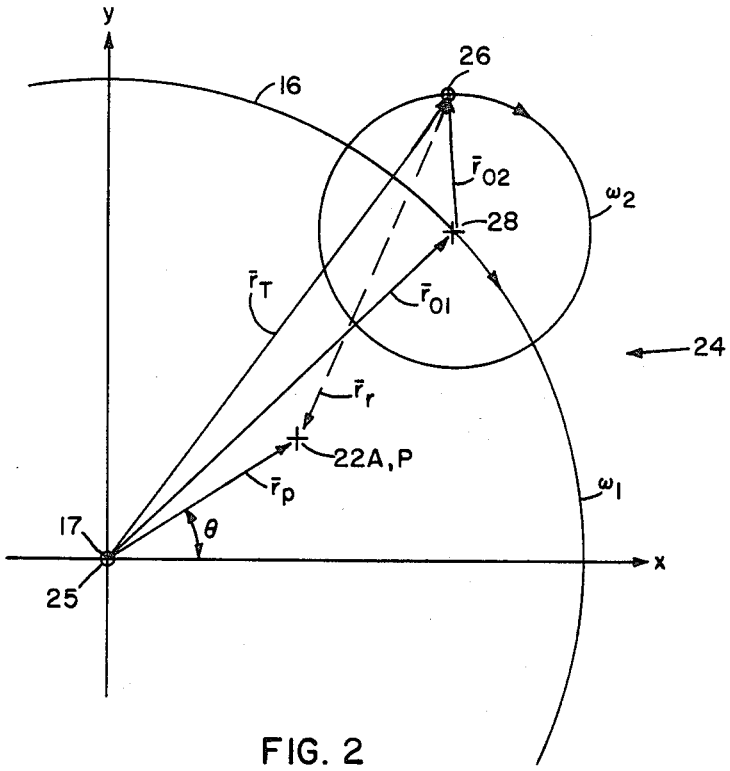
FIG. 2 is a diagrammatic image of a cross-section of the laser beam path taken normal to the boresight axis in the plane of a missile.

FIG. 2 shows the center of laser intensity in a plane 24 of the missile for a given instant. A cartesian coordinate system, which identifies the plane, is normal to and has the X-Y axis origin 25 thereof located on the LOS or boresight axis 17. The rear surface 22A or that portion of the missile which houses the receiver 23 detector circuitry of missile 22 is disposed at location P a distance $\bar{r}_p$ from origin 25. The transmitted laser beam is a Gaussian beam having the center 26 disposed for rotation at the end of a vector $\bar{r}_{02}$. Vector $\bar{r}_{02}$ rotates in a circular path centered at point 28 on path 16. Thus, the point 28 may be considered as remaining fixed with respect to Gaussian beam center 26 which rotates around the point in a circular pattern. However, the point 28 rotates around the boresight axis 17 (or point 25) at a vector distance $\bar{r}_{01}$ from the boresight axis. The center 26 of the Gaussian beam varies a vector distance $\bar{r}_T$ with respect to point 25 and $\bar{r}_r$ with respect to the missile receiver as the plane 24 of the missile progresses toward the target area. The Gaussian beam has intensity (I) at point P which is well defined as:

$$I = Ae^{-\frac{|\bar{r}_r|^2}{\sigma^2}} \tag{1}$$

where A is the maximum intensity at the center of the Gaussian beam and $\sigma$ describes the beam width. Thus equation (1) defines the shape of the transmitted laser beam. As shown in FIG. 2, $\bar{r}_{01}$ spins around point 25 with radial frequency $\omega_1$, and $\bar{r}_{02}$ spins around the end of $\bar{r}_{01}$ with radial frequency $\omega_2$. Summing the vectors of FIG. 2, $$|\bar{r}_r|^2 = |\bar{r}_{01} + \bar{r}_{02} - \bar{r}_p|^2 = |\bar{r}_T - \bar{r}_p|^2. \quad (2)$$

The vectors $\bar{r}_{01}$, $\bar{r}_{02}$, $\bar{r}_p$ may be written in component form as:

$$\bar{r}_{01} = (|\bar{r}_{01}| \cos \omega_1 t, |\bar{r}_{01}| \sin \omega_1 t); \quad (3)$$

$$\bar{r}_{02} = (|\bar{r}_{02}| \cos \omega_2 t, |\bar{r}_{02}| \sin \omega_2 t); \text{ and} \quad (4)$$

$$\bar{r}_p = (x_p, y_p). \quad (5)$$

From these equations, the signal detected at the missile is found to be:

$$\frac{|\bar{r}_T - \bar{r}_p|^2}{\sigma^2} = \frac{|\bar{r}_{01}|^2 + |\bar{r}_{02}|^2 + |\bar{r}_p|^2}{\sigma^2} + \frac{2|\bar{r}_{01}\bar{r}_{02}|}{\sigma^2} \cos[(\omega_1 - \omega_2)t)] - \frac{2|\bar{r}_{01}|\ |\bar{r}_p|}{\sigma^2} \cos(\omega_1 t - \theta) - \frac{2|\bar{r}_{02}|\ |\bar{r}_p|}{\sigma^2} \cos(\omega_2 t - \theta), \quad (6)$$

where the angle $\theta$ in FIG. 2 is defined as $$\theta = \tan^{-1} \frac{y_p}{x_p}. \quad (7)$$

Missile position information may be obtained from either of the last two terms of equation (6). The polar coordinates of the missile positioned with respect to boresight are given by $(|\bar{r}_p|, \theta)$ and have their origin also at point 25 (FIG. 2). The term $|\bar{r}_p|$ is obtained within the missile by amplitude demodulation of equation (6) about either center frequency $\omega_1$ or $\omega_2$ and the term $\theta$ is also obtained from phase demodulation about either one of the frequency terms. The remaining terms—$\bar{r}_{01}$, $\bar{r}_{02}$, and $\rho$—are known constants.

The four terms in equation (6) are each centered about a different frequency—one term is not time dependent; one term is centered at $\omega_1$-$\omega_2$; one term at $\omega_1$; and one term at $\omega_2$. The two terms centered at $\omega_1$ and $\omega_2$ are each amplitude and phase modulated. The amplitude modulation is given by $|\bar{r}_p|$, which is the magnitude of the distance between the boresight and the missile location. The phase modulation is given by $\theta$ which is simply the angular direction of the missile with respect to the positive real x-axis as illustrated in FIG. 2. Consequently, by proper demodulation, the missile's precise location with respect to the boresight is obtained.

The missile position is determined by properly scanning the laser beam itself, and no spinning reticle or other beam encoding techniques are needed. Therefore, the optical system does not need to be an imaging system. It is only necessary to provide the two scanning motions and to scale the Gaussian beam as a function of missile range. The two scanning motions are a rapid rotation of the $|\bar{r}_{02}|$ vector about the $|\bar{r}_{01}|$ vector and the slower revolution of the $|\bar{r}_{01}|$ vector about the boresight.

As has been noted hereinabove, a complex signal is transmitted to the missile through the optical link, with the signal's components falling roughly into four locations in the spectrum. The information bearing components of the signal are those centered at $\omega_1$ and at $\omega_2$. Since both of these components contain enough information to track the missile location with respect to boresight only the component centered at $\omega_1$ is considered for example $$\frac{-2|\bar{r}_{01}|\ |\bar{r}_p| \cos(\omega_1 t - \theta)}{\sigma^2} \quad (8)$$

Expression (8) (partial equation (6)) represents a signal that is both amplitude and phase modulated. The phase modulation $\theta$ is simply the missile direction from boresight, and the amplitude modulation $|\bar{r}_p|$ is just the distance from boresight. These two parameters give the missile location in polar coordinates as measured from boresight.

Figure 3:
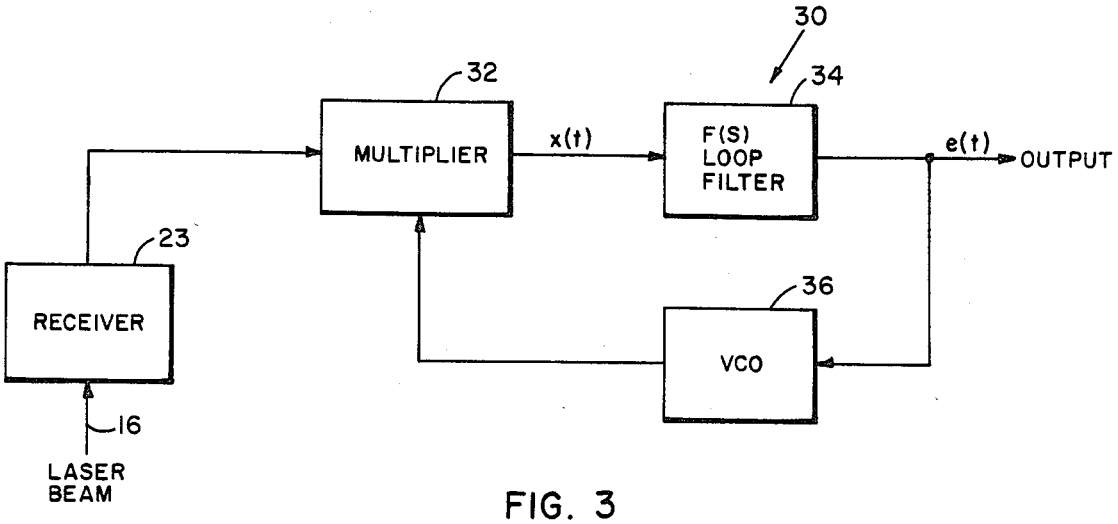
FIG. 3 is a block diagram of a phase locked loop circuit for maintaining track of the laser beam.

A coherent detector such as a phase locked loop is employed to detect the phase of the received signal. A block diagram of a phase locked loop is shown in FIG. 3. The operation of the loop is highly non-linear, basically, falling into two categories—acquisition and tracking. During acquisition the loop locks onto the frequency and phase of the signal to be demodulated. For beamrider systems, the acquisition function can be readily performed before the missile is launched, while the missile and launcher are in physical contact. After acquisition occurs, the phase locked loop tracks changes in the phase of the signal after the missile is launched. A loop can be routinely designed to track the phase, the first derivative of the phase, the second derivative of the phase, and so on. The ability to track higher derivatives of the phase depends on the number of poles in the loop filter F(s) shown in FIG. 3.

The phase locked loop 30 of FIG. 3 takes the incoming detected signal from receiver 23 and couples it through a multiplier 32 and the loop filter 34 before coupling the detected output signal e(t) as an output to established control circuitry for driving missile vanes or fins. Feedback of e(t) to a voltage controlled oscillator (VCO) 36 results in a variable feedback coupled to multiplier 32.

The information concerning the missile's position is contained in the term $|\bar{r}_r|^2$. Any attenuation in intensity, I, caused as the beam passes through the atmosphere is separated from the rest of the signal in the receiver circuitry by taking the logarithm of I in equation (1). Thus, $$\ln I = \ln A - \frac{|\bar{r}_r|^2}{\sigma^2}. \quad (9)$$

Typically, such beam attenuation will be of much lower frequency than the information bearing components of $|\bar{r}_r|^2$.

Figure 4:
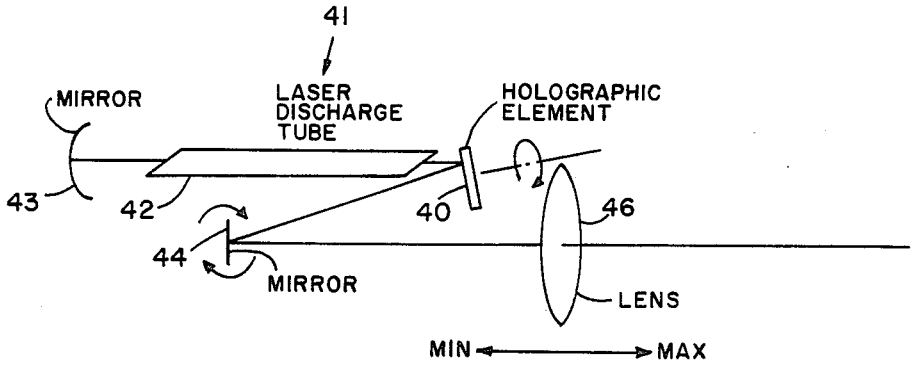
FIG. 4 is a preferred optical circuit for providing the two circular motions of the laser beam around the boresight axis, as shown in FIG. 2.

The optical transmitter 12 system that provides the beam motion of FIG. 2 is shown in FIG. 4. In a laser 41 a phase reflection holographic scanner 40 replaces the partially reflective end mirror adjacent to laser discharge tube 42. The fully reflecting mirror 43 at the opposite end of the laser cavity remains unchanged. As the scanner 40 spins around an axis normal to its face, it provides the rapid scanning motion of the $\bar{r}_{02}$ vector. The infrared radiation from the laser reflects off this scanner onto a galvinometer controlled mirror 44 which provides the lower frequency circular scanning motion of the $\bar{r}_{01}$ vector. The output from mirror 44 is coupled through a single element lens 46 as the Gaussian beam output. Lens 46 is moveable linearly in the path of the beam. The moveable lens 46 is used to scale the laser beam diameter at the missile position. This function may be better understood with the help of FIG. 5 wherein the optical path is shown as being unfolded even though elements 40 and 44 are actually reflective. A beam 50 is reflected from mirror 43 through the system and focused by lens 46. The basic task is to keep the diameter of the Gaussian beam constant at the missile position. This is accomplished by varying the separation between output lens 46 and the holographic scanner 40 at the end of the laser cavity. Holographic element 40 has a focusing power of $f_h$ in order to focus the beam to a waist size $W_{02}$. The output lens 46, with focal length $f_l$, focuses the beam to a waist size of $W_0$. The beam diameter $W_z$ must be a constant at the missile receiver 23, a variable distance z from output lens 46.

The missile range z is always located in the far field of the Gaussian beam, that is:

$$z >> \frac{\pi W_o^2}{\lambda}. \tag{10}$$

This means that the Gaussian beam is a constant diameter at the missile range z when the waist size $W_o$ is related to range by $$W_o = \frac{\lambda z}{\pi W_z}. \tag{11}$$

Table 1 shows the relationship between z and $W_o$ for a value of $W_z = 1$ m and for laser wavelength $\lambda = 10.6$ microns.

TABLE 1

| z(m) | $W_o$(m) |
|---|---|
| 50 | $0.168 \times 10^{-3}$ |
| 500 | $1.68 \times 10^{-3}$ |
| $10^3$ | $3.3 \times 10^{-3}$ |
| $3.0 \times 10^3$ | $10.1 \times 10^{-3}$ |
| $5.0 \times 10^3$ | $16.9 \times 10^{-3}$ |

Figure 5:
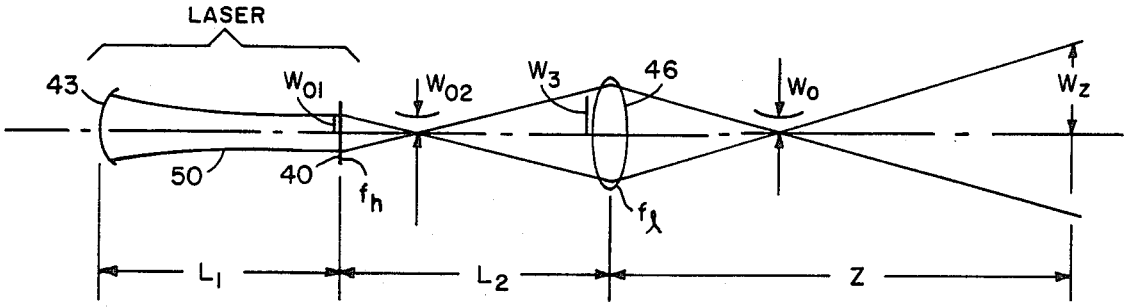
FIG. 5 is a diagrammatic view of the optical path shown unfolded.

A typical design of a system as shown in FIG. 5 is:

$L_1 = 30$ cm
$R_1 = 10$ m
$R_2 = \infty$
$\lambda = 10.6 \times 10^{-6}$ m.

Where $L_1$ is the laser cavity length, $R_1$ and $R_2$ are the radius of curvature of elements 43 and 40 respectively, and $\lambda$ is the laser beam wavelength. By use of standard Gaussian equations, the beam waist at the laser exit is found to be $W_{01} = 2.4 \times 10^{-3}$ m. The combination of the holographic element and the output lens can be viewed as a telescope. To get the required waist size for operation at 5 km, the telescope needs a magnification of $16.9 \times 10^{-3}$ divided by $2.4 \times 10^{-3}$, or about 7. For a shorter range it is only necessary to move the refractive lens slightly to "ruin" the telescope.

Using f/5 holographic optics for the 10.6 micron wavelength the focal length of the holographic scanner $f_h$ can be computed by using the expression $$f/\# = f_h/(3W_{01}), \text{ or}$$

$$5 = f_h/(3)(2.4 \times 10^{-3}); \text{ therefore}$$

$$f_h = 36 \times 10^{-3} \text{ m}, \tag{12}$$

where f/# is the optical f-number.

For a typical $f_h = 50 \times 10^{-3}$ m), then $f_l = (7)(50 \times 10^{-3}\text{ m}) = 0.35$ m.

For this value of $f_l$ the telescope magnification is 7 as noted hereinabove. Therefore the beam diameter at lens 43, $W_3$, is $16.8 \times 10^{-3}$ m, and the required diameter of the lens is simply $3W_3 = 50.4 \times 10^{-3}$ m. Consequently, when the missile is at maximum range, z=5 km, the value of $L_2$ is $f_h + f_l = 0.4$ m. The Gaussian beam waist is located 2.8 m from the output lens which is much less than the value for z. To produce the proper beam diameter at other ranges lens 46 is moved to the left, decreasing the value of $L_2$. For example, for a missile range of 723 m the lens would be positioned 0.01 m to the left and at a range of 50 m, the lens would be located 0.15 m to the left of the maximum range position. The lens moves less than 1 cm while the missile travels from 1 km to 5 km, but it moves approximately 14 cm during the first 1 km of flight. Since missile velocity is known, the lens 46 drive mechanism, need only be reference to launch of the missile to begin automatic travel from minimum to maximum range synchronously with missile flight.

A holographic scanner element diffracts a laser beam into a single spot that will scan over the desired pattern as the scanner is translated. Only the simple rotational motion of the scanner is required to generate the motion of the scanned beam. As with other holographic elements, these can be constructed by recording the interference pattern between two coherent wavefronts. However, there are several advantages to constructing these holographic scanners as computer generated holograms. The Computer Generated Holographic Scanner (CGHS), set forth by Bryndahl and Lee (O. Bryngdahl and W. H. Lee, "Laser Beam Scanning Using Computer Generated Holograms," Applied Optics, Volume 15, pp. 183–294, Jan 1976), utilizes a digital computer to calculate and plot an appropriate fringe pattern which will cause the laser beam to scan the desired pattern.

Should the reconstruction beam have a simple Gaussian wavefront, the reconstructed wavefront is an astigmatic Gaussian. Such a beam propagates as an astigmatic line. The line-focus characteristic lowers the maximum radiance and reduces the scanner resolution. However, eliminating a deleterious effects of this aberration is accomplished by aligning the major axis of the astigmatic Gaussian with the scan direction. The astigmatic Gaussian can then be rotated to align with the scan direction.

To rapidly acquire lock-on to an incoming signal, a high bandwidth loop is used; however, to track phase variations accurately a small loop bandwidth is usually needed. Also, the ability of the loop to acquire and track the signal depends on the number of poles in the closed loop transfer function; the number of which is one more than the number of poles in the loop filter F(s). A loop transfer function with one pole is called a first order loop; a function with two poles is a second order loop, and so on. A first order loop can track a constant shift in the phase of the signal; a second order loop can track a constant shift in the first derivative of the phase; a third order loop can track a constant shift in the second derivative of the phase, and so on. Consequently, when the phase of a received signal changes in an erratic manner, a low order loop will not track the phase accurately. While higher order loop designs are much more sensitive, stability can be a problem. They can be rendered unstable with less provocation than lower order loops. For these reasons, it is important to anticipate the type of phase variations expected in the received signal and use an appropriate loop. Phase fluctuations are affected by missile dynamics and pointing jitter introduced by the gunner and by atmospheric fluctuations during target tracking.

A problem that can arise in missile tracking occurs because the phase of the received signal shifts by $\pi$ radians each time the missile passes through boresight. Similarly, each time the missile passes near boresight the signal phase changes very rapidly. It is impossible for a basic loop to track these sudden and rapid variations; the loop temporarily loses lock and cannot track a missile's position accurately until it reacquires lock. This problem is readily eliminated by simply locating the boresight position a predetermined distance away from the origin 25 of the $(|\bar{r}_p|, \theta)$ polar coordinate system (FIG. 2). Tracking can be accomplished with the boresight located on or off the origin, however, with it off the origin, performance is improved. The tracking signal from the phase locked loop can also be used as a synchronous local oscillator signal for coherent AM demodulation. In this capacity, however, a complication occurs because the performance of the phase locked loop used for phase tracking depends on the amplitude modulation of the signal. This occurs because the loop bandwidth actually depends on the amplitude of the received signal. Large signal amplitude means large loop bandwidth, and large bandwidth aids in phase acquisition. So, when phase lock is lost as the missile passes through boresight, a large bandwidth is necessary to reacquire lock. This occurs when the distance between the missile and boresight is small. Therefore, the amplitude of the signal is small, and the loop has a small bandwidth. To remedy this problem, an automatic gain control in a feedback loop can compensate for loss in signal amplitude. The gain control is determined from the signal produced by the amplitude demodulation operation, so the performance of phase tracking is closely related to the performance of amplitude tracking, which itself depends on the phase tracker to provide the receiver local oscillator (not shown) for amplitude demodulation.

Another guidance problem can momentarily occur when the laser beam is temporarily blocked by an intervening obstacle. However, a median filter may be used in the receiver to hide the fact that the signal has been interrupted. This is because a short interruption of the signal can be viewed as a negative impulse; this is precisely the kind of noise that a median filter is good at removing.

While the invention has been described in connection with a specific embodiment thereof, it should be understood that further modifications will suggest themselves to persons skilled in the art and the embodiment is intended to cover such modifications as may fall within the scope of the claims appended hereto.

We claim:

1. In a beamrider missile guidance system wherein a target is tracked by line-of-sight from a tracking station and a missile is directed toward the target substantially along the line-of-sight axis, a method of directing the missile toward the target and comprising the steps of:

visually tracking a target from a target tracking station, directing a laser beam of optical energy from said target tracking station toward said target and along a path offset a constantly varying distance from said line-of-sight;

directing a missile toward said target within the path of said optical energy beam; and generating correctional guidance within the missile in response to the position of said missile away from the line-of-sight and within said beam.

2. A method of directing a missile toward a target as set forth in claim 1 and further comprising the step of rotating said constantly varying beam of optical energy around said line-of-sight along a first circular path at a first fixed radius from the line-of-sight within a plane passing through said missile.

3. A method of directing a missile toward a target as set forth in claim 2 and further comprising the steps of rapidly rotating said beam in a second circular path at a second fixed radius around said first circular path at the first fixed radius to provide said constantly varying offset from the line-of-sight.

4. A method of directing a missile toward a target as set forth in claim 3 and further comprising the step of spinning a holographic element in the path of said beam of optical energy and thereby providing the step of rapidly rotating said beam in said second circular path.

5. A method of directing a missile toward a target as set forth in claim 4 and further comprising the step of oscillating a mirror in the path of said beam of optical energy for rotating said constantly varying beam along said first circular path.

6. A method of directing a missile toward a target as set forth in claim 5 and further comprising the step of moving a focusing lens within and along the path of said beam for maintaining said first and second fixed radii in said plane passing through the missile.

7. A beamrider missile guidance system for directing a missile toward a target and comprising: apparatus for transmitting an optical beam having a Gaussian distribution toward said target, means for maintaining said target in a line-of-sight; a missile for traversing the path of said optical beam, a receiver system on said missile responsive to said optical beam for directing the missile trajectory within said beam substantially along said line-of-sight; and wherein said apparatus for transmitting said optical beam comprises a laser cavity having a fully reflective end mirror at one end and a partially reflective means at the output end, optically scanning means, and adjustable focussing means in optical alignment; said partially reflective means being a holographic element adapted for spinning to impart a rapid, circular motion to the beam, said optically scanning means being a mirror disposed for scanning said beam in a low frequency circular scan around said line-of-sight, and said adjustable focussing means being a lens adapted for linear movement within said beam.

8. A beamrider missile guidance system as set forth in claim 7 wherein said holographic element is a phase reflector holographic scanner, said holographic scanner rotating said beam in a circular path while said beam moves along the low frequency circular scan around said line-of-sight.

* * * * *